United States Patent [19]

Granville

[11] Patent Number: 4,590,871

[45] Date of Patent: May 27, 1986

[54] AUTOMATIC MAIN SEAM FEEDING AND FORMING APPARATUS

[76] Inventor: John M. Granville, 21922 Scallion Dr., Saugus, Calif. 91350

[21] Appl. No.: 729,688

[22] Filed: May 2, 1985

[51] Int. Cl.[4] ..... D05B 35/04

[52] U.S. Cl. ..... 112/142; 72/176

[58] Field of Search ..... 112/142, 147, 141, 149, 112/152, 153, 157, 137, 136; 72/176, 52

[56] References Cited

U.S. PATENT DOCUMENTS

| | | | |
|---|---|---|---|
| 1,652,396 | 12/1927 | Dallas | 72/52 |
| 1,681,880 | 8/1928 | Schneible | 72/52 |
| 1,988,401 | 1/1935 | Thompson | 112/142 X |
| 4,476,792 | 10/1984 | Diacont, Jr. et al. | 112/142 |

*Primary Examiner*—Werner H. Schroeder
*Assistant Examiner*—Andrew M. Falik
*Attorney, Agent, or Firm*—Thomas D. Linton

[57] ABSTRACT

An automatic main seam feeding and folding device which has an automatic feeding and folding die which folds two adjacent edges of fabric to form a fell seam and feeds the fabric seam to a sewing machine while maintaining the proper tension and edge alignment. The feeding and folding die folds the adjacent fabric edges from an initial zero degrees of fold to a final overlapping interlocking 180 degree fold to form a main seam and includes tractor dogs along the right and left sides of the die block to continously feed the fabric material. The tractor dogs push the material along the outside of a straight solid die block with the fabric edges to be folded moving within a slot which encloses and contains the fabric spacially. The feeding and folding die is made sufficiently long to enable the two fabric edges to be gradually folded from a parallel planar flat position at the die mouth to a 180 degree, one inch interlocking four layer folded fell seam configuration at the die terminus or nose.

10 Claims, 6 Drawing Figures

AUTOMATIC MAIN SEAM FEEDING AND FORMING APPARATUS

FIELD OF THE INVENTION

This invention relates to automatic seam forming and manufacturing devices and more particularly relates to an automatic main seam feeding and folding die for manufacturing parachutes.

BACKGROUND OF THE INVENTION

Seams, particularly in parachutes, are made by folding edges of the fabric material and stitching the folded seam with two or four needle sewing machines. A typical personnel parachute has a full canopy about 30 feet in diameter which is basically an assembly of 28 gores, each gore about 14 feet long, radiating outward from the center of the canopy. The center of the canopy, called the vent, joins the top of the 28 gores forming the parachute. The bottom of the parachute canopy is called the skirt, along which the ends of the gores are sewn into a skirt hem. Adjacent sections of the 28 gores are held together by what is called main seams. These main seams are four layer fell seams which are generally about one inch wide and have four layers of folded material comprised of one inner and one outer fold layer from each gore edge. Each gore's inner fold is one inch wide and lies between the other gore's inner and outer folds.

The canopy assembly is formed by joining the first gore to a second gore by taking one edge from each gore and folding and sewing the edges into a four layer fell seam main seam. Thus each additional gore is joined to the canopy by a main seam.

Each gore is generally made of several three or four foot long selvages sewn together by one half inch wide four layer fell seams called cross seams which run circumferentially around the canopy. These cross seams are generally not hard for the operators to sew because they are narrower, only ½ inch in width, than main seams and because they are folded parallel to the warp (or fill) of the woven nylon fabric. However, main seams between adjacent gores are folded at about 45 degree bias angle to the warp (or fill) which is a complicating aspect of main seam sewing. The susceptibility of fabric to folding is inversely proportional to the angle between the fold and the warp (or fill). Parachutes generally are manufactured from 1.1 ounce or so ripstop nylon fabric that is approximately 0.007 (7 thousandths of an inch) thick, which will form four layer fell seams approximately 0.032 (32 thousandths) thick comprised of four layers of material plus thread.

Since before World War II, parachute canopy main seams have been formed by a simple sheet metal folder about 5 inches long which is used to make one inch wide four layer fell seam main seams. The presently used sheet metal folder has two 180 degree contours which interfold the two edges of the gores. The present method of manufacturing the main seam requires a great deal of skilled sewing operator labor in terms of manual dexterity and job experience since the operator must prefold each of the two edges exactly one inch for proper inner-fold width and simultaneously rotate each prefolded edge 90 degrees and simultaneously maintain exactly the right amount of tension in each of the two gore fabrics against the pull of the sewing machine feed. The material is folded over and fed through the sheet metal folder into the bite of a two or four needle sewing machine and is pulled along by the action of the reciprocating feed dog and a clamping foot of the sewing machine. The existing sheetmetal folder plays no role in the proper tensioning or edge alignment of the two edges. Thus at present it takes a great deal of skilled labor to continuously fold and sew parachute main seams, and other fabric fell seams wider than ½ inch.

It is therefore one objective of the present invention to provide an automatic feeding and folding die for delivering folded seams to a sewing machine.

Still another objective of the present invention is to provide an automatic feeding and folding die which pre-folds the seam prior to its entry into the sewing machine.

Yet another objective of the present invention is to provide an automatic feeding and folding die for the continuous fabric feeding and fabric edge folding of a canopy fabric edge and an adjacent gore fabric edge into a four layer fell seam main seam.

BRIEF DESCRIPTION OF THE INVENTION

The present invention relates to an automatic main seam feeding and folding device which has an automatic folding apparatus known as a die, which folds the edges of fabric and also mechanically interfaces with a fabric feeding apparatus, known as a tractor. The tractor feeds both the canopy and gore fabric edges through the die, while the die folds the edges into the fell seam shape of two inner and two outer folds. Proper edge alignment of both fabric edges within the die is maintained. The tractor details form no part of the invention herein.

The automatic feeding and folding die is unique in design. The feeding and folding die not only folds the fabric from an initial zero degrees of fold to a final overlapping interlocking 180 degree fold, but also has tractor dogs which operate along the right and left walls of the die block. The tractor dogs feed or pull fabric along the outside of the straight solid die block with the fabric moving into a slot which encloses and contains the fabric spatially. The feeding and folding die is made sufficiently long to enable fabric to be gradually folded from a parallel planar flat position at the die mouth to a 180 degree, one inch interlocking fold at the die terminus or nose. The slot depth is equal to the fabric width inside the die and is constant since the die block is straight. Thus the die slots bend the fabric edges around each other into a four layer fell seam shape. The complex non-conical irregular die slot curve develops to make the interlocking innerfolds. Both gore and canopy slots are of equal and constant depth through the die. Generally the slot depth is approximately three times the width of the seam being formed.

The thickness of the slot should be substantially greater than the fabric thickness due to the passage of the cross seams through the die block. With the ripstop nylon fabric of parachutes having a thickness of about 0.007 (7 thousandths) the four layer fell seam main seams will be approximately 0.032 inches (32 thousandths) including the stitching. However, since the gores of the parachutes are formed from selvages having ½ inch four layer fell seam cross seams which are effectively much thicker than the fabric, about 0.050 inches or more, a slot thickness of about 0.082 thousandths is used to allow the die slots to easily and cleanly pass the thick cross seams through.

Since the tractor dogs move the fabric by rotary or linear motion along the lateral sides of the die block the lateral sides must be substantially flat. Further, the tractor also lifts up in separating itself from the fabric therefore the tractor dogs must detach from the lateral sides of the walls of the die. Thus, the die block lateral walls must be smooth and have no protruberances.

Due to limitations in the machining processes used in fabricating the die, a feeding and folding die having slots which progressively fold or interlock fabric edges within each other, from zero degrees of fold through a progression of complex curves to 180 degrees of fold, the die block may be made in as many as three to five or more segments varying about two to five or more inches in length. Thus the final completed die will have an overall length in the range of roughly 10 to 25 or more inches with about 18 inches being preferred.

A constant slot depth of about 3.375 inches is used to form a one inch wide main seam fell seam. Of that 3.375 inches, one inch is the inner fold, one inch is the outer fold, and the other 1.375 inches is taken up by the vertical distance between the inner and outer folds and by the lateral distance from the outer fold through the die block wall to the outside of the die block.

Also, the extra 1.375 inches allows for a smooth symmetrical convergence of the two slots as they progressively wrap inside one another along the length of the folding die. While the 1.375 inches could reduced somewhat, if the reduction was carried too far, the slots would simply collide with one another.

At the entrance or mouth of the die, the canopy and the gore being sewn to the canopy are lying approximately flat with the edges being overlapped approximately 3.375 inches from right to left. At the entrance to the mouth of the die the vertical displacement between the canopy and the gore fabrics is approximately 3 inches. As the canopy and gore edges are fed through the die one edge rotates downward counterclockwise and the other edge rotates upward counterclockwise as the edges are gradually folded over the length of the long die block until the innerfold of each edge has been folded 180 degrees and lies within the inner and outer folds of the other edge. At the terminus or nose end of the die block the folded seam is fed into the foot and reciprocating feed dog of a two or four needle sewing machine for stitching.

Preferably the reciprocating feed dog of the sewing machine, and the feed dogs of the tractor device feeding the material through the die, are synchronized such that the tractor maintains a very slight tension on the material as it passes through the die.

The above and other features of the invention will be fully understood from the detailed description and the accompanying drawings, in which:

BRIEF DESCRIPTION OF THE DRAWINGS

FIG. 5 is a view taken at the terminus or nose end of the feeding and forming die as the folded fabric exits from the feeding and forming die.

DETAILED DESCRIPTION OF THE INVENTION

Figure 1:
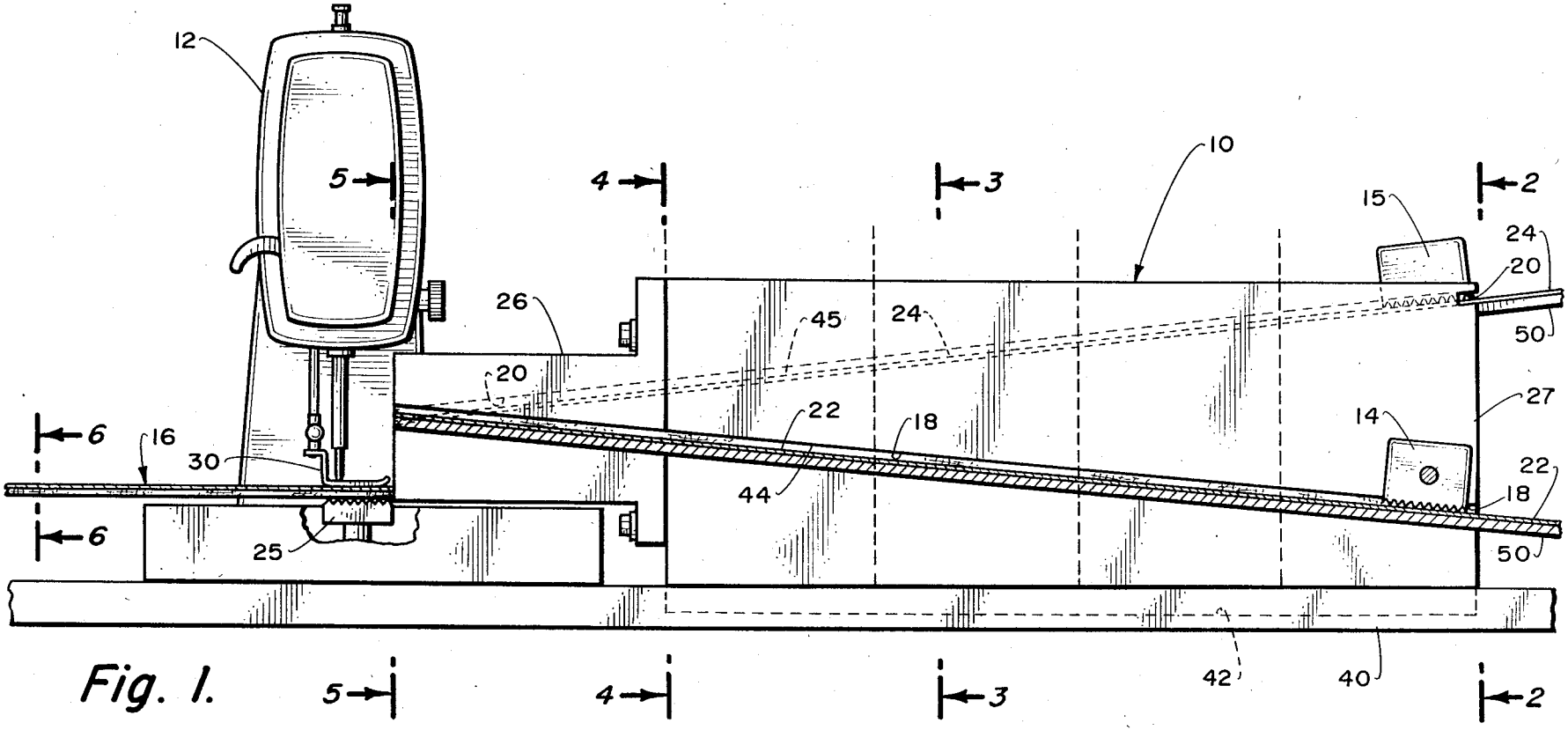
FIG. 1 is a side elevation of an automatic main seam feeding and folding apparatus including a feeding and forming die.

An automatic main seam feeding and forming apparatus is illustrated in FIG. 1 and is comprised of a feeding and forming die 10, a sewing machine 12 for sewing the main seam and fabri feed tractor dogs 14 for feeding the canopy fabric 22 and gore fabric 24 through the die 10. The feeding and forming die 10 has slots 18 and 20 respectively for receiving a canopy 22 and a gore 24 to be added to the canopy. The slots 18 and 22 have a preselected depth to provide an overlap of the canopy 22 and gore 24 in a ratio of overlap to finished seam width of approximately 3 to 1. The ratio of the length of the feeding and forming die 10 is 3 to 9 times the depth of the slots 18 and 20 formed in the die. This length is necessary to permit the material of canopy 22 and gore 24 to gradually progress through the die to form the folded interlocked four layer fell seam main seam.

Figure 2:
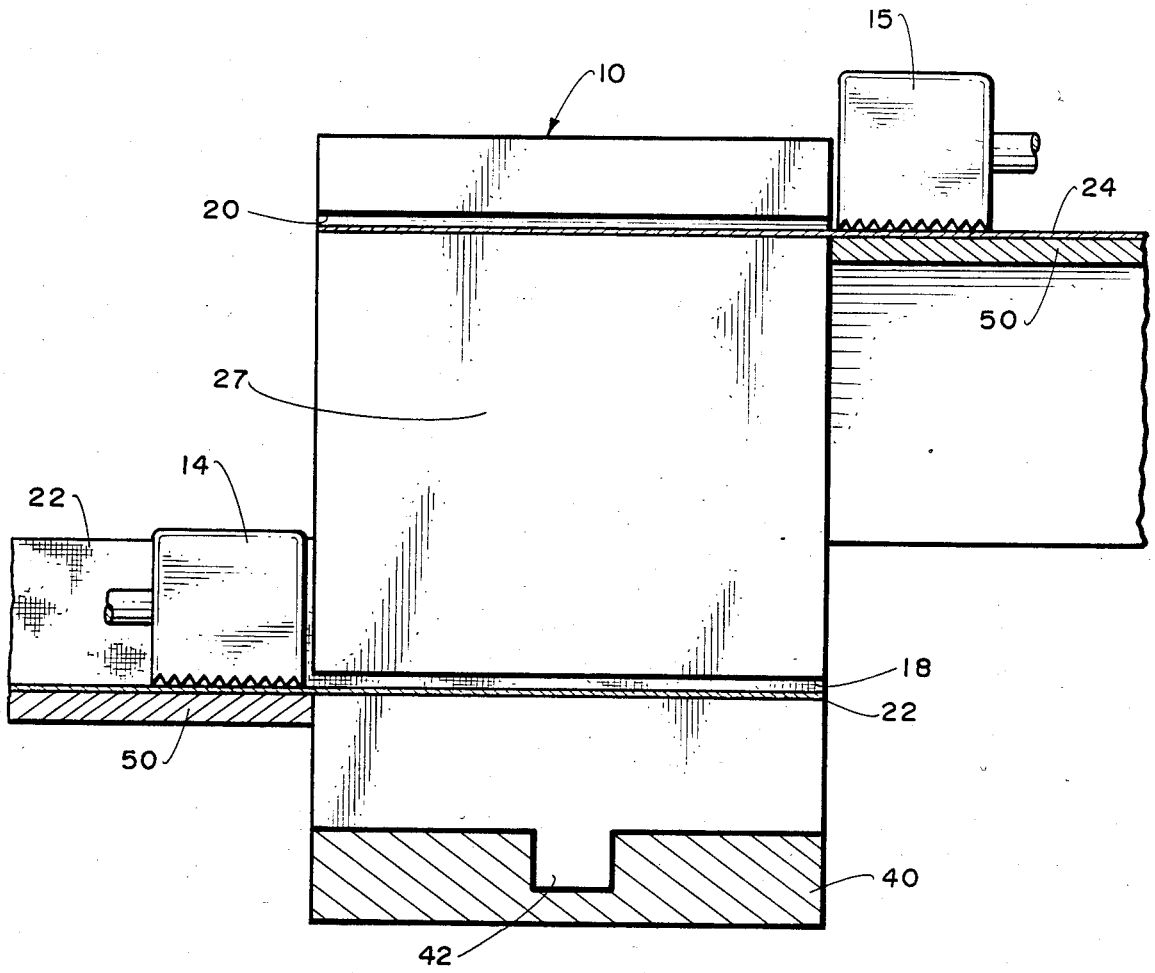
FIG. 2 is an end view showing the entrance mouth to the automatic main seam feeding and forming die.
Figure 3:
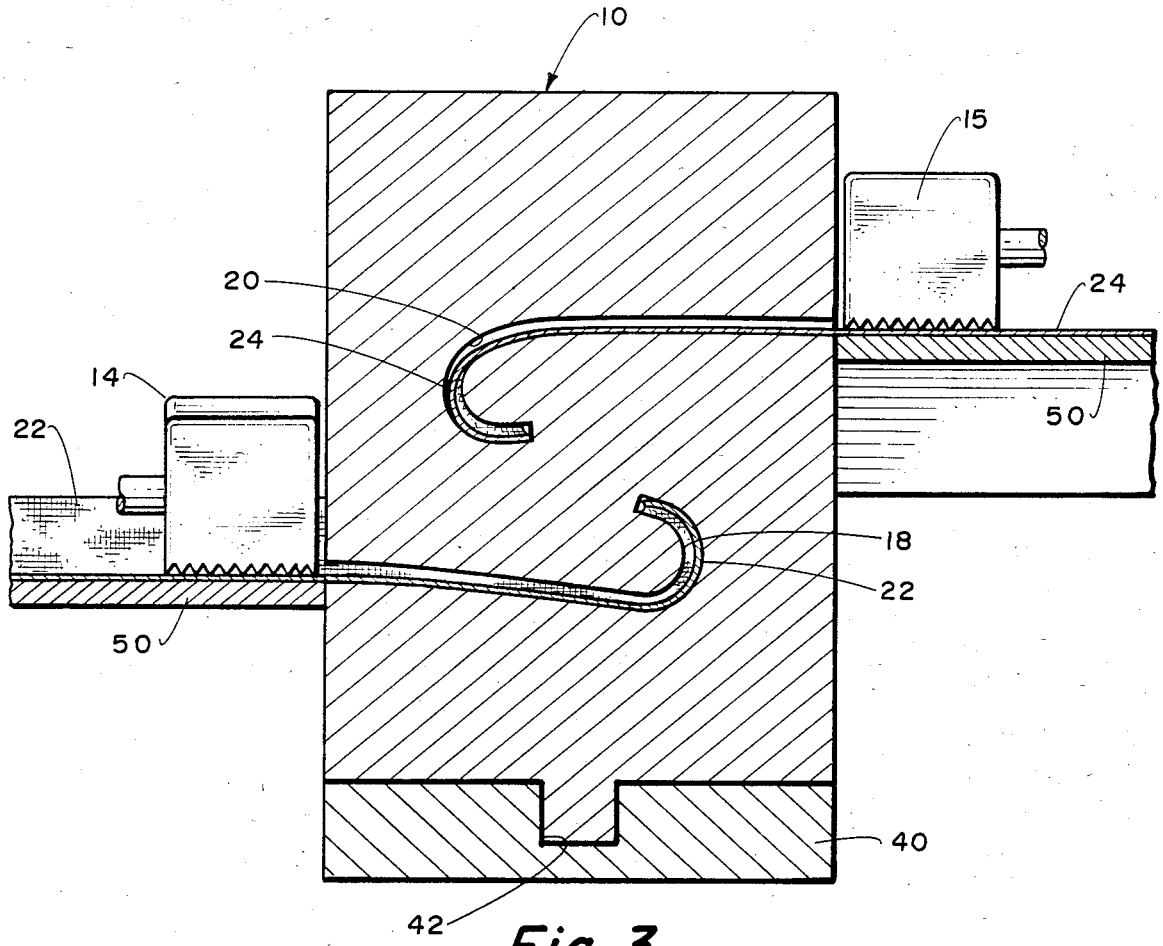
FIGS. 3 through 5 are sectional views taken through the automatic main seam feeding and forming die at progressive intervals from the mouth feeding and forming die at progressive intervals from the mouth (beginning) of the die block to the end of the die block to the end of the die at the terminus of the nose at the sewing machine needle pressure foot.
Figure 4:
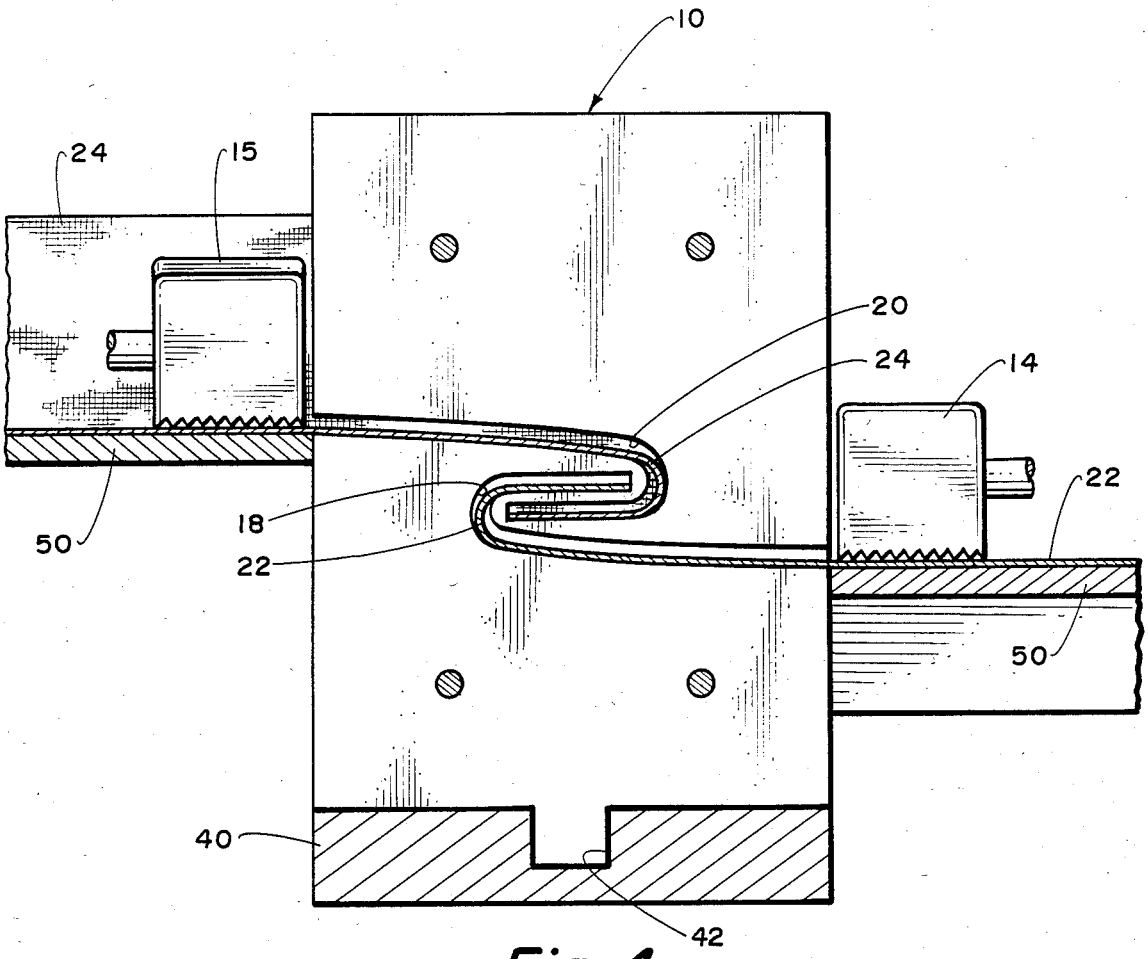
Figure 5:
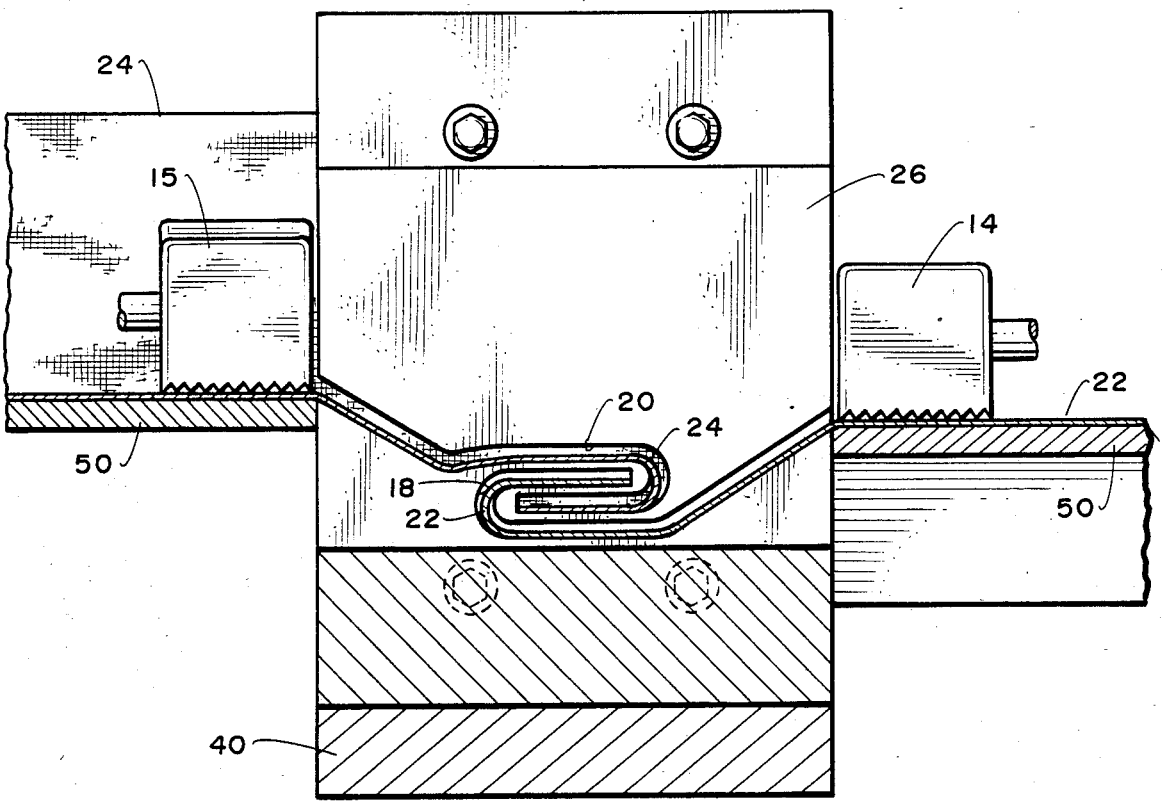

The progression of material through the die can be seen in the progressive sectional views 2 through 5. FIG. 2 illustrates the entrance or mouth of the die 10 looking toward the sewing machine as from the position a sewing machine operator normally sits. The die 10 receives the fabric to be formed into a seam for sewing. The canopy 22 (or the first gore of a canopy) is fed into slot 18 which has a depth in the die 10 of approximately 3 times the width of the seam to be formed. Simultaneously a gore 24 to be sewn to the canopy is fed into slot 20 having a depth identical to that of slot 18 providing a horizontal overlap of the gore and canopy fabrics of about 3 times the width of the seam to be formed. The canopy 22 and gore 24 respectively are progressively fed into the die 10 by tractor dogs 14 and 15 of a tractor mechanism, the details of which form no part of the invention herein. Preferably the tractor dogs 14 and 15 move in synchronization with a feed dog 25 of sewing machine 12 in FIG. 1. The slots 18 and 20 progressively form the fabric edges into overlapping bends while simultaneously approaching one another until the fabric edges are folded as illustrated in FIG. 5. This is accomplished by not only having the slots 18 and 20 progressively bend toward each other from zero to 180 degrees, but also having them taper toward each other in vertical and horizontal convergence until they are interlocked as illustrated in FIG. 5.

The overfolded edges of the canopy 22 and gore 24 emerge from the end of the die known as the nose (nose 26 in FIG. 5) of the die 10, to be received by the bite of sewing machine 12 formed by presser foot 30 and reciprocating feed dog 25 (FIG. 1). Feed dog 25 reciprocates feeding the folded fabric 16 in FIG. 1 through the bite of the sewing machine. The bite is principally composed of an upper pressure foot 30 and a lower feed dog 25 (FIG. 1).

The fold is about one inch wide and it passes into the sewing machine needle/feed-dog/presser foot mechanism. The presser foot itself is about 1.25 inches in width.

The lateral portion of the fabric edges are outside of the presser foot and are held in compression by the bottom of the tractor dogs as shown in FIG. 5.

The thickness of the slots 18 and 20 forming in the feeding and folding die 10 are in the range of 10 to 15 times the thickness of the fabric material being passed through the die. Since the cross seams in the gores have thicknesses of fabric plus the thread of approximately 0.032 inches (32 thousandths), the thickness of the die slots is some 2 to 4 times the thickness of the cross seams to allow the cross seams to pass through the die without excessive frictional drag. The vertical separation between the canopy and gore fabrics is approximately 3 inches at the die mouth (FIG. 2) and is near 0 at the die nose terminus (FIG. 5). Also preferably, the die is made of material having favorable properties in terms of machinability and of resistance to wear, abrasion and corrosion.

Figure 6:
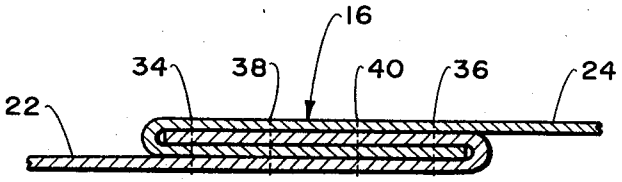
FIG. 6 is a sectional view through the fabric of the main seam illustrating the inner and outer folds and needle stitches.

The folded seam is illustrated in FIG. 6 with the canopy 22 sewn to the gore 24 by stitches 34 and 36 made by a sewing machine with two needles. A sewing machine with four needles would place additional stitching at 38 and 40.

The folding die described will provide a properly folded main seam for parachutes which when stitched will meet all military specifications, particularly those pertaining to overfolds and underfolds in which the inner fold of either or both edges is too long or too short respectively.

In addition to the features described above, optional but preferred features are the use of a slotted bed plate 40 (FIG. 2) for receiving a flange 42 for positioning the die in proper alignment with the sewing machine 12. Additionally, the die may be fabricated in segments which are then joined. This makes the precision machining of the complex non-conical slots possible. For example, the die illustrated in FIG. 1 could be made in five segments as indicated by the vertical dotted lines in FIG. 1 and then joined to form the completed feeding and forming die.

The slope of the canopy and gore slots at the outer wall of the die block is known as the vertical exit height (VEH) of the slot. Both canopy and gore VEH slopes form a straight line of constant slope from the die nose terminus at the needle all the way back to the die block mouth 27 (FIG. 1) so that the tractor dogs can push the fabric along a path which is straight both vertically and horizontally. Numerial 44 designates the canopy outer fold exit height. Numeral 45 designates the gore outer fold exit height. Numeral 50 designates a table top.

The angle between the gore and canopy VEH slopes causes the fabric edges to diverge vertically in the direction away from the needle back toward the die mouth. This vertical separation is required to give the tractor dogs and other machine elements the necessary space to operate in their performance of the fabric movement, fabric tensioning and edge alignment functions.

Thus there has been disclosed an automatic main seam feeding and forming apparatus including a feeding and forming die for prefolding seams for joining adjacent edges of fabric such as forming main seams in a parachute. The feeding and forming die is preferably formed with ratios of depth of slots, slope of slots, thickness of slots, and length of die to allow fabric to be freely fed through the die and properly folded.

This invention is not to be limited by the embodiment shown in the drawings and described in the description which is given by way of example but not of limitation but only in accordance with the scope of appended claims.

What is claimed is:

1. An automatic seam feeding and forming apparatus comprising:

a die block;

a pair of vertically spaced apart slots in said die block along opposite sides; said slots progressing through said die block at a depth providing a predetermined overlapping relationship from an entrance end to a nose end and progressively bending toward each other from approximately zero degrees to approximately one hundred and eighty degrees as said slot passes through said die block;

means progressively feeding fabric edges through said block whereby said fabric edges emerge from said nose end in an overfolded seam.

2. The apparatus according to claim 1 in which the ratio of the length of said slots in said solid die block to the depth of said slots is 3 or more.

3. The apparatus according to claim 2 in which said slot length to slot depth ratio is in the range of 3 to 9.

4. The apparatus according to claim 1 in which the ratio of the overlapping portion of said slots to the width of said seam being formed is approximately three.

5. The apparatus according to claim 1 in which said slots in said solid die block have a thickness which is approximately in the range of 2 to 4 times the thickness of the material when formed into an ovrfolded seam.

6. The apparatus according to claim 1 in which said means for moving said material comprises;

a shelf formed along each side of said solid die block adjacent each of said slots; and moveable tractor dogs position to engage material along said shelfs and progressively move said material through said die block.

7. The apparatus according to claim 6 including; means for mounting said die block nose adjacent a sewing machine feed dog; said tractor dogs and feed dog being moved in synchronization.

8. The apparatus according to claim 1 in which said die block is a solid chunk of metal.

9. The apparatus according to claim 1 in which said die block is formed of a plurality of solid segments in abutting relationship.

10. The apparatus according to claim 9 in which said die block is formed of five solid block segments.

* * * * *